US005205279A

United States Patent [19]

Brown

[11] Patent Number: 5,205,279

[45] Date of Patent: Apr. 27, 1993

[54] LINEAL SLOT VENTILATION SYSTEM

[76] Inventor: Stephen L. Brown, 13144 Tudor Dr., Carmel, Ind. 46032

[21] Appl. No.: 735,282

[22] Filed: Jul. 24, 1991

[51] Int. Cl.[5] ..... F24C 15/20

[52] U.S. Cl. ..... 126/299 R; 126/299 D; 454/67

[58] Field of Search ..... 126/299 R, 299 A, 299 B, 126/299 C, 299 D; 98/115.1, 115.4; 454/49, 53, 67

[56] References Cited

U.S. PATENT DOCUMENTS

| | | | |
|---|---|---|---|
| 2,577,150 | 12/1951 | Plendger | 126/299 R |
| 2,868,108 | 1/1959 | Petersen | 126/299 D |
| 3,500,740 | 3/1970 | Aubrey | 98/115 |
| 3,513,766 | 5/1970 | Ahlrich | 98/115.1 |
| 3,785,124 | 1/1974 | Gaylord | 98/115.1 |
| 3,854,388 | 12/1974 | King | 98/115.1 |
| 4,089,327 | 5/1978 | Welsh | 126/299 D |
| 4,153,044 | 5/1979 | Nett | 126/299 D |
| 4,506,655 | 3/1985 | Kuechler | 126/299 D |
| 5,069,197 | 12/1991 | Wisting | 126/299 D |

*Primary Examiner*—Larry Jones
*Attorney, Agent, or Firm*—Woodard, Emhardt, Naughton, Moriarty & McNett

[57] ABSTRACT

A kitchen ventilator is mounted in the wall behind the cooking units and has a horizontally extending intake slot located close to the cooking surface. A roof-mounted upblast fan is coupled through connecting duct to the ventilator to establish a vacuum in the system. Room air travels over the cooking surface into the slot and is baffled down toward the bottom of the ventilator and then turned 180 degrees around the bottom edge of the baffle to centrifugally remove some contaminants. The air moves upward to the top of the baffle and is drawn through baffle-style filters where additional contaminants are removed. The baffle is removable to facilitate cleaning. Clean-out doors in the front face of the ventilator above the intake slot give easy access to the filters for removal and cleaning or replacement of them. A funnel around and under the fan assembly takes rain and snow from the fan assembly and drains it through the connecting duct and ventilator to sewer.

20 Claims, 4 Drawing Sheets

LINEAL SLOT VENTILATION SYSTEM

BACKGROUND OF THE INVENTION

1. Field of the Invention

This invention relates generally to kitchen ventilation systems, and more particularly to a system for removing cooking fumes from the area adjacent a cooktop.

2. Description of the Prior Art

In the art of kitchen ventilation, there is a variety of equipment. Some terms commonly used are "hood", "ventilator", "exhaust duct", "exhaust fan", and "water wash ventilator". Such terms have meanings generally as follows:

Hood: Inverted box shape structure usually constructed of sheet metal, and hung above the cooking appliances. Lowest edge of box is at a minimum of 78 inches above the floor for operator head clearance. The components of the hood required by building codes include: Underwriters Laboratories (U.L.) labeled grease filters, grease drip tray located beneath grease filters and pitched for drainage of grease collected by the filters to a removable collection cup. Cup capacity is not to exceed one gallon. Light fixtures, listed for installation in a commercial grease hood, must be installed to produce a minimum of 70 foot candles of light at the cooking surface. Hoods, as an industry standard, must project horizontally beyond the vertical projection of the cooking appliance area a minimum of 6 inches on all open sides.

Ventilator: General shape is rectangular when viewed from the front and, when viewed from the side, similar to 45° triangle with the right angle at the ventilator's highest point along the wall and the hypotenuse running from the ventilator's lowest point at the wall out and up to its highest point farthest out from the wall. The height of the ventilator above the floor is determined by the type of cooking appliances placed under the ventilator. Codes require a minimum of 24 inches from the top of the cooking surface to a maximum of 48 inches above the cooking surface to the bottom edge of the filters over char broilers. The components of the ventilator required by building codes include: U.L. labeled grease filters, a grease drip tray located beneath grease filters and pitched for drainage of grease collected by the filters to a removable collection cup. Cup capacity is not to exceed one gallon. Ventilator must project beyond the cooking appliances only enough to completely cover the length of the appliances. The ventilator width must be sufficient to come within 12" of the front of the cooking surface.

Exhaust Duct: pipe or enclosure usually welded to the top of either a hood or ventilator device and running vertically or horizontally up and out of the building. Ducts terminate at a powered exhaust fan.

Exhaust Fan: Motor driven or powered fan mounted to draw air exhausted through the device into and through the connecting duct system into the fan for discharge away from the building.

Water Wash Ventilator (U.L. designation—grease extractor): Constructed in the configuration of a hood or ventilator. The grease filters are replaced by an extraction chamber including baffles and fixed pipe loop with nozzles placed to wash the interior of the extraction chamber. The pipe system is connected to a remote control panel with time clock and other required safety and operating components. The removable grease collection cup is replaced by a drain connected directly to a building floor drain. All visible areas of the water wash hood or ventilator require the same type of manual cleaning described below.

Both the hood and ventilators described above are completely contained within the kitchen. Grease and smoke extracted from the cooking area through either device creates the need for cleaning of all components exposed to the exhausted smoke and grease, including the duct connecting the device to an exhaust fan mounted outside of the building. All sheet metal parts, grease filters, grease cups, light fixtures ducts and fans require this cleaning. Both the hood and the ventilator are mounted directly above the cooking appliances. In both, the grease laden filters and collection cups must be removed from the holding frames to be cleaned in a dishwasher or large soak sink. The remaining components must be cleaned where they are mounted. Since they are mounted directly above the cooking appliances, the cooking appliances must be covered or otherwise protected while the device is cleaned. The normal method for cleaning the device is hot water under pressure or steam from a steam generator. A canvas or plastic funnel must be constructed to capture and carry away to a floor drain, the water used in cleaning. The requirements for cleaning these devices tend to limit the frequency of cleaning, because the cooking appliances must be turned off. This is normally done after the restaurant closes, and requires at least one employee to stay after hours to monitor the cleaning crew and lock up after the cleaning is complete. Proper cleaning requires two or six or more hours, depending on system size and configuration. Therefore, complete cleaning is normally limited to one to four times per year. Meanwhile, grease filters, collection cups and exposed portions of the device must be cleaned more often. These removable accessories and exposed surfaces are cleaned as often as daily in most well run operations. This requires an employee to devise a way to get up to the filters and cups and into the device. Filters and cups must be removed, carried to wherever they will be cleaned, cleaned and then returned and replaced in the device. The exposed surfaces of the device are wiped down by hand. The ventilation system is typically the most difficult part of a building to clean other than the kitchen floor. The floor however requires only a mop and bucket, and can be mopped with the cooking appliances on or off.

Considering the foregoing, it is an object of this invention to provide a kitchen ventilating system that is easy to clean.

Further regarding prior art, conventional ventilators of the canopy or backshelf design mount above or beside the cooking appliances. Building codes require an air space between the cooking surface and the grease filter in the ventilator, for fire safety. Temperatures in excess of 1,200 degrees are present at the surface of some cooking appliances. Filters collect and hold grease extracted from the exhaust air. This accumulating grease presents a flash fire hazard at temperatures above 400 degrees. By providing the space required by the codes, cooler air from the room is drawn across the cooking appliance and into the ventilator to carry away the cooking by-products of grease and smoke, as well as the heat. The air space separating the cooking surface and the filter is there to facilitate a reduction in the cooking fume temperature as cooler room air is mixed with the cooking fumes as they move farther from the cooking surface.

A typical cooking surface is 36 inches or more above the finished floor. Codes require from 24 to 48 inches clearance above the cooking surface to the bottom edge of the grease filter in a canopy hood installation. Even with some specially designed grease filters, the minimum dimension is 16 inches. A typical hood or ventilator height dimension is 12–24 inches from filter bottom to top of ventilator. Adding the minimums of 12 inch hood height plus 16 inches minimum from the bottom of the grease filter to the top of the cooking surface and a cooking surface height of 36 inches above the floor, equals 64 inches of vertical wall space consumed and unusable.

Backshelf-type ventilators are desirable in many cases where it is desirable to serve food items over the top of a ventilator such as in cafeteria line, cook-to-order operations, and full service kitchens where the chef wants to face the person picking up or calling in food orders, while cooking. A minimum ventilator height of 64 inches such as mentioned above, is unacceptably tall for the chef to pass food over the top of the ventilator. In contrast, for an installation where the food is to be passed over the top of the ventilator, a ventilator top height of 47 inches is an acceptable height for pass-over operation.

It is therefore another object of this invention to remove fumes from the area adjacent a cooking surface and pass them through grease filters located a safe distance from the source of heat and flames but without consuming excessive kitchen wall or floor space, and still have the filters accessible for cleaning. It is a further object to reduce the overall height of the device for pass-over operation.

Referring further to the prior art, a fixed pipe water wash ventilator such as mentioned above, only cleans the extraction plenum. All surfaces exposed to view must be cleaned just like the conventional devices. The mechanics of the water wash system require professional maintenance. Lack of or improper service of the more complicated self cleaning feature, of conventional water wash ventilators, along with routine mechanical breakdowns, cause the self cleaning feature of these ventilators to be inoperable at times. The very nature of the term "self cleaning" implies that no physical check of the area to be self cleaned, is required. Therefore, problems often go undetected. It is also impossible in some designs, and very difficult in other designs, to manually wash the concealed extraction area when the self cleaning feature is inoperable.

Therefore another object of this invention is to provide a lower cost alternative to water wash extractors used in food service operations. It is also an object of this invention to provide a device that can be conveniently cleaned with a portable water spray system while allowing access, by the operator, to all areas of the ventilator and make all areas accessible for visual inspection.

Further referring to prior art problems, the building wall surfaces between the cooking appliances and the conventional devices must be cleaned, and become unusable space for anything that cannot be in direct contact with the grease and smoke laden exhaust air. The conventional ventilators and hoods hang into the room and consume wall and ceiling space. All interior space in today's food service buildings is at a premium. It seems that there is never enough space and it costs too much. Another object of this invention is to make wall space above the ventilator usable for storage shelves or other food preparation uses, and avoid use of floor space for the ventilator, so that cooking appliances can be placed directly against the face of the wall fronting the ventilator excepting allowances for utility connections at the appliances.

Another aspect of kitchen ventilation systems includes the exhaust duct and fan. Upblast spun aluminum exhaust fans are the standard for food service ventilation. The powered roof fan is placed on top of a roof curb. The curb supports the fan and is used for sealing the roof opening required to allow passage through the roof, of the duct which connects the roof fan to the ventilator inside the building. The fan pulls the grease laden air through the ventilator inside the building and through the connecting duct into the fan and then discharges out the top of the fan away from the building. All components of the system become coated with grease which gets through the grease filters and is carried in the exhaust air stream. The collected grease builds up inside all components. Only the fan is outside the building and exposed to the elements. The fan, by building code, must be open to the atmosphere, with no baffles or diverters that might be useful to deflect snow or rain, in the air stream. Therefore, rain water and snow can enter the top of the fan. The fan's design must keep the snow and rain out of the building and, therefore, drains this water out at the base of the fan. These drains allow the collected grease inside the fan to drain out. The rain water and snow also become contaminated with the grease collected inside the fan, and carry additional portions of the collected grease out of the fan to the roof. In addition, the wind bands on typical upblast grease exhaust fans are larger than the square base. Leaks occur at the assembly joints and assembly bolts around the wind bands. The top wind band must be removable for cleaning access to the fan wheel assembly. Being removable makes it virtually impossible to keep this joint leakproof. Roofing materials, whether treated paper and tar, or some newer membrane materials, are usually petroleum by product based. The animal and vegetable fats in the collected grease from the kitchen act as a sponge, drawing the oil by-products out of the roofing material. This drawing out leaves the roofing material dry and brittle. Cracking and roof leaks follow this drying out. Many membrane roofing suppliers will not warrant their materials against attack by grease from food service ventilation. So the deposits of grease on the roof are not only unsightly, but also are destructive to the roof. It is therefore another object of this invention to avoid roof deposits of grease from exhaust fans.

SUMMARY OF THE INVENTION

In a typical embodiment of the invention, a ventilator is wall mounted behind the cooking unit. Air flow is induced by a roof mounted air handler. The ventilator has an intake slot located as close as possible to the cooking surface. As room air travels over the cooking surface into the slot, it retains the heat and emissions generated by the operation of the cooking unit. On entering the ventilator slot, the air with cooking fumes is forced down by an interior baffle toward the bottom of the ventilator. Upon reaching the bottom edge of the interior baffle the air is turned 180 degrees. Some cooking fume products are removed centrifugally at the bottom of the baffle. The air moves up the back of the interior baffle into the grease filters. The baffle-style grease filters remove additional emissions. These filters run the full horizontal length of the ventilator. Clean-out doors are provided in the front face of the ventilator above the intake slot for easy access to the filters for cleaning them and the interior of the ventilator. The rooftop fan housing drains through the exhaust duct and ventilator to the floor drain to sewer, to keep grease off the roof and facilitate cleaning the fan and duct.

DESCRIPTION OF THE PREFERRED EMBODIMENT

Figure 1:
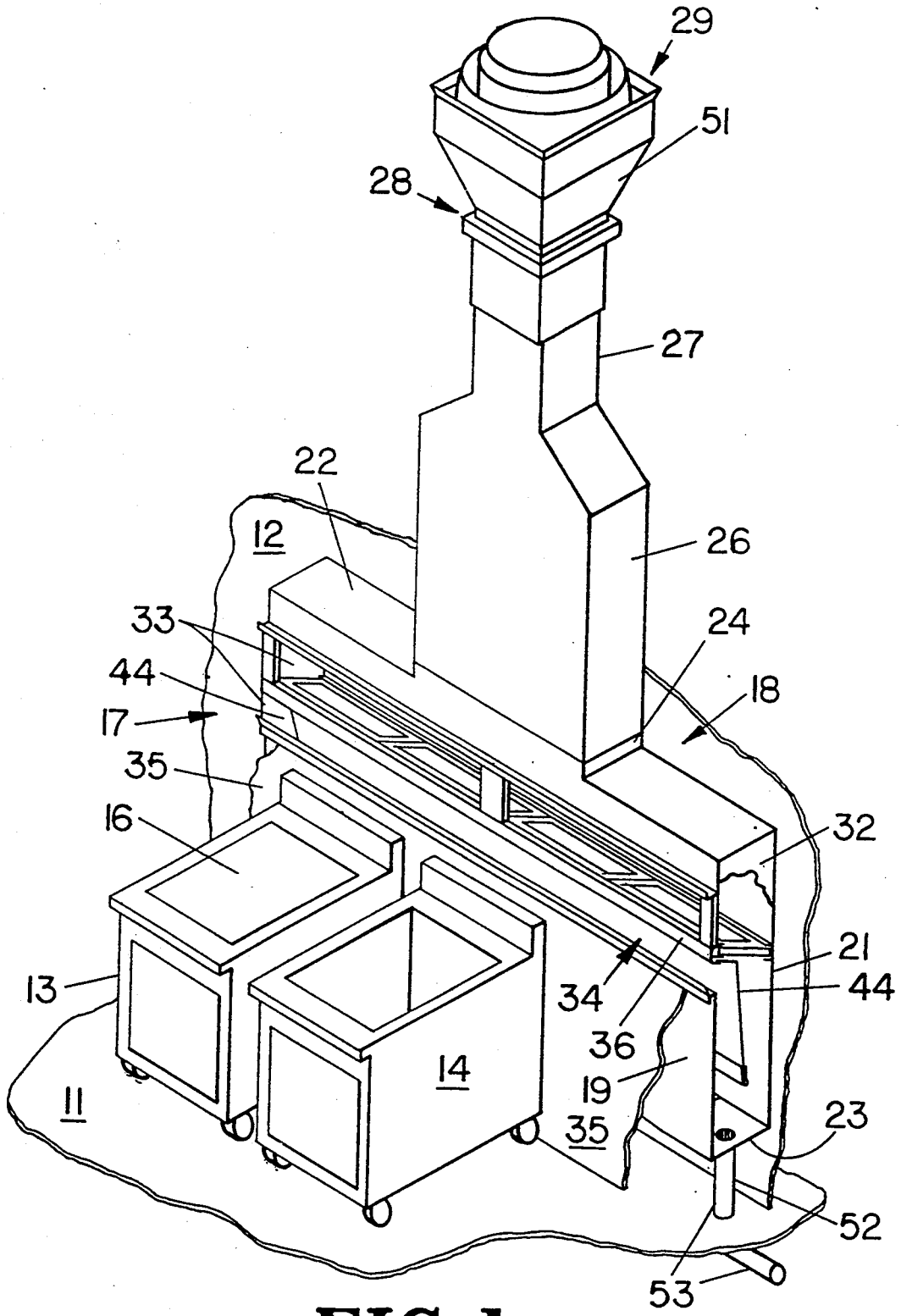
FIG. 1 is a pictorial view of the lineal slot ventilator installation according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings which are not precisely to scale, in FIG. 1, there is shown pictorially, a kitchen installation of the ventilator of the present invention. In FIG. 1, a portion of the floor 11 and wall 12 of a building are shown with two cooking units 13 and 14 supported on caster wheels on the floor 11. The cooking units may be identical, or they may be different. In any case, each of them has a top from which cooking fumes rise during the cooking operations. As an example, the top 16 of the unit 13 may be a grill. For the unit 14, it could be a deep fat fryer. Regardless of the nature of the unit, the present invention is effective to remove air in the direction of the arrow 17 from the area immediately above the cook top and thereby remove fumes and heat from the cooking operations.

More specifically, the ventilator 18 has front, rear, top and bottom walls 19, 21, 22 and 23, respectively. Top wall 22 has a central opening with an exhaust collar 24 around it and which is connected to the exhaust duct 26–27 having first part 26 rising straight up from wall 22, and then converging to second part 27 extending from the upper end of the first part straight up into the roof curb assembly 28 where it communicates with the exhaust blower unit 29 which discharges to atmosphere in the direction of the arrow 31. Although the right-hand end wall 32 of the ventilator is broken away to show interior details in FIG. 1, the entire right-hand end is closed as is the left-hand end with a left-hand end wall 33. Also, in order to show the filter array, filter access doors are omitted from FIG. 1.

Figure 3:
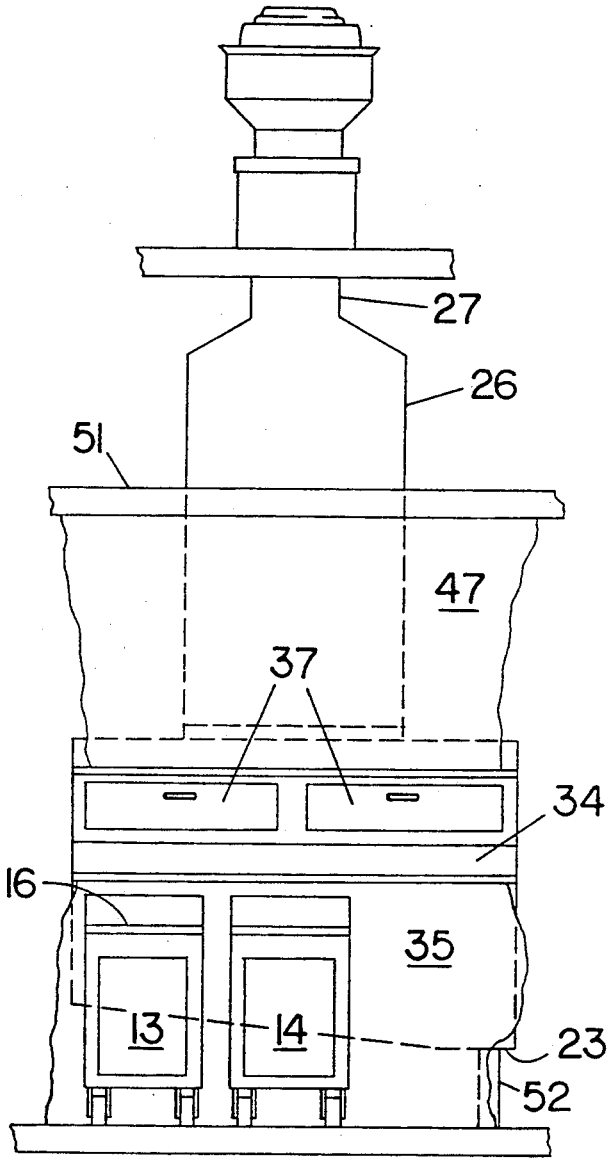
FIG. 3 is a front elevational view.
Figure 2:
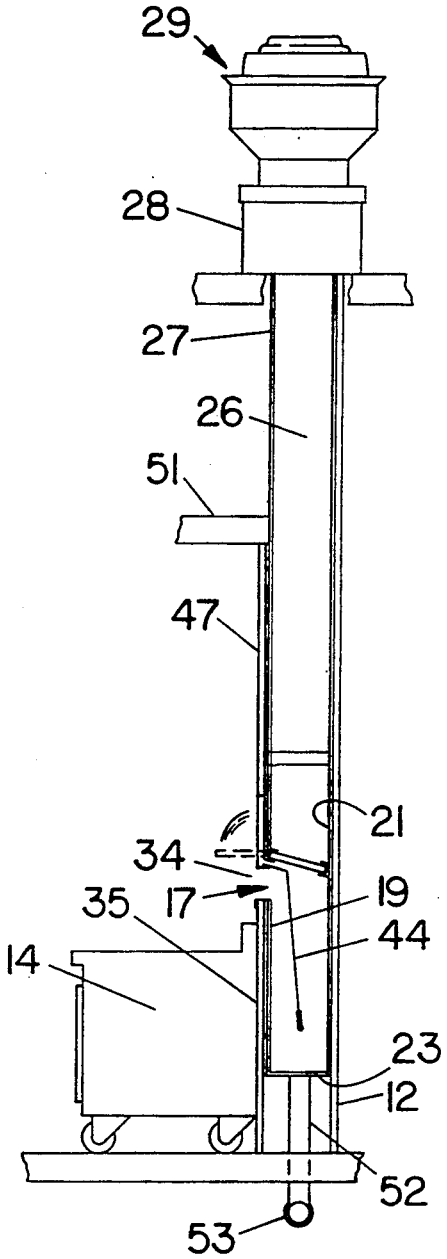
FIG. 2 is a vertical section through the installation.
Figure 4:
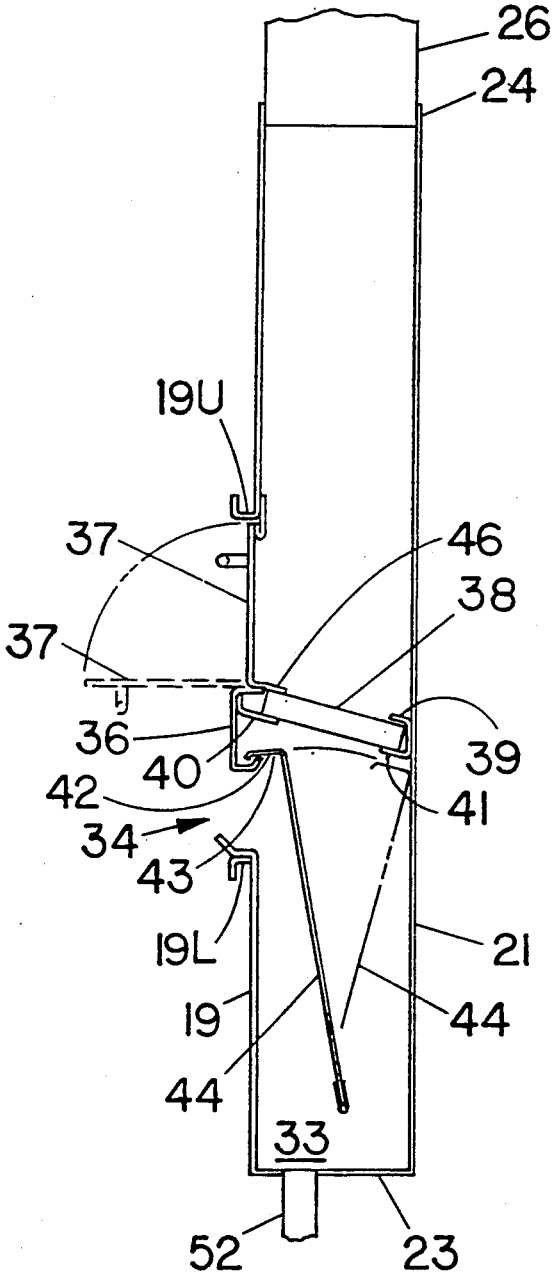
FIG. 4 is an enlarged vertical section through the ventilator itself.
Figure 6:
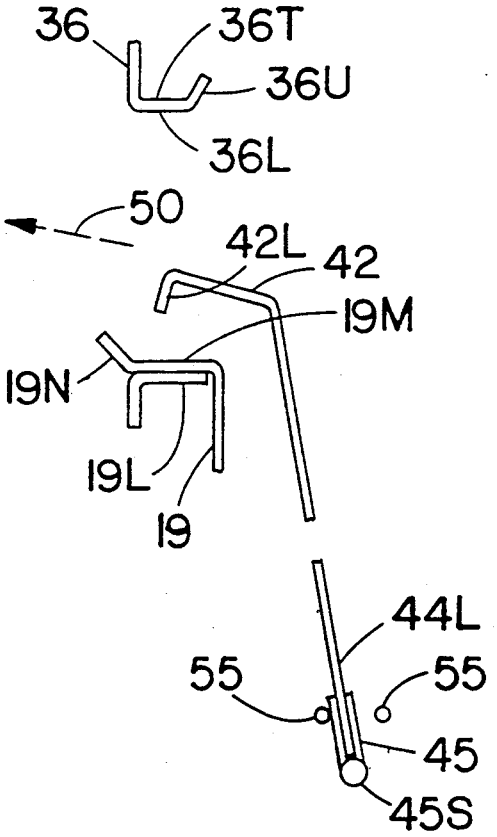
FIG. 6 is an enlarged fragmentary view on the same scale as FIG. 5 and showing the location of the baffle lower edge just before the baffle is pulled out of the ventilator for cleaning.

A horizontally extending intake slot 34 is provided in the front wall 19. The bottom of the slot is defined by the upper margin of the front wall 19 which is turned forward at 19M and then slightly upward at 19N (FIG. 6). An elongate angle-section member mounted on the bottom of the forwardly turned portion 19M of the lower front wall cooperates therewith to provide a downwardly opening groove 19L which receives the upper edge portion of the wallboard or other building wall surface material for the kitchen wall 35 below the ventilator intake slot. A combination facing and stiffener member 36 provides the upper border of the slot 34 and also serves as the mount for a couple of clean-out doors 37 (FIG. 3) in the upper front face of the ventilator and which are hinged to the upper marginal portion of the member 36 to swing out and down as shown by the dotted lines in FIGS. 2 and 4. There are six filter elements 38 behind these doors. These are the centrifugal baffling-type of grease separators. An example is No. F501016 filter marketed by Component Hardware. They are inclined downward toward the rear and, as is best shown in FIG. 4, the rear edges of these filters are confined between a pair of inwardly turned, longitudinally extending flanges 39 and 41 mounted on the back wall 21 of the ventilator. The front edge of each of these filters rests on an elongate angle-section bracket 40 fastened to the inside face of the member 36. The clean-out door 37 has a longitudinally extending angle flange 46 at its lower inner edge and which serves to limit upward travel of the front edge of the filter 38 when the clean-out door is closed. However, when the clean-out door is open as shown in the dotted line in FIG. 4, that angle flange is moved out of the way so that the filter can be lifted with the front edge upward first up and out from inside the ventilator for cleaning and/or replacement.

Figure 5:
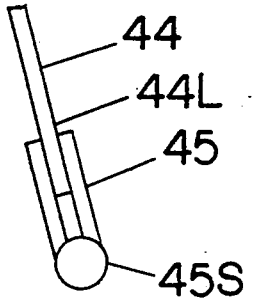
FIG. 5 is a further enlarged portion of the FIG. 4 drawing to show the relationship of the lower marginal portion of the internal baffle to the hinged mount for it when the baffle is in the normal operating position.

Referring now to FIG. 6, along with FIGS. 4 and 5, the lower marginal portion of the member 36 is turned inwardly toward the rear at 36L and then upwardly at 36U to form an upwardly opening trough 36T. This serves to support the upper front marginal portion 42 of a plate which extends rearwardly and slightly downward to a line 43 about one-third of the way into the space between the front wall 19 and the rear wall 21 and then turns downwardly at 43 to form a downwardly and slightly rearwardly extending baffle 44.

An elongate, upwardly opening channel 45 is mounted on a shaft 45S which is pivotally mounted in the end walls 32 and 33 of the ventilator so that it can pivot through a limited arc about a horizontal axis. The lower marginal portion 44L of the baffle 44 is received in this channel. Normally the baffle is held in the position shown in FIGS. 4 and 5 by the downturned lip 42L at the upper margin thereof being supported in the trough 36T of member 36. In this condition, the lower marginal edge of the baffle plate is spaced above the shaft 45S, so it does not rest in the bottom of the channel 45 even though it is still confined in the channel. This construction facilitates removal of the baffle if desired for more thorough cleaning of it and the inner surface of the back wall 21. To do this, the baffle is lifted so that the lip 42L is pulled up out of the trough 36T, and then the baffle is lowered to the position shown in FIG. 6 where the lower edge of it rests in the bottom of the channel 45. Then it can be pulled out of the ventilator through the slot 34 in the direction of the arrow 50. Appropriate stop posts 55 can be mounted in the end walls 32 and 33 to prevent the channel 45 from pivoting out of a generally upright attitude as that would make it difficult to return the baffle into the channel after cleaning.

A groove 19U is provided on the upper front wall of the ventilator by either forming a break in the material itself or by attaching a separate Z-shaped piece to the front, and receives the drywall 47 (FIG. 2) or other wall surfacing material above the ventilator and which extends up to the ceiling 51. This groove also serves to catch any grease which might be running down any vertical surfaces above it. As previously mentioned, groove 19L is provided at the upper edge of the front panel 19 below the slot 34 to receive drywall 35 or other wall finishing material at that location Thus, the wall material 35 below the slot 34, and the material 47 above the slot provide the kitchen wall surface behind the cooking appliance. A hole is provided in the bottom 23 of the ventilator at the right-hand end for departure of liquids which have run down the sloping bottom 23 to the right hand end and into a drain line 52 which is connected to the sewer 53. The entire bottom 23 is pitched to facilitate draining to drain 52.

Figure 7:
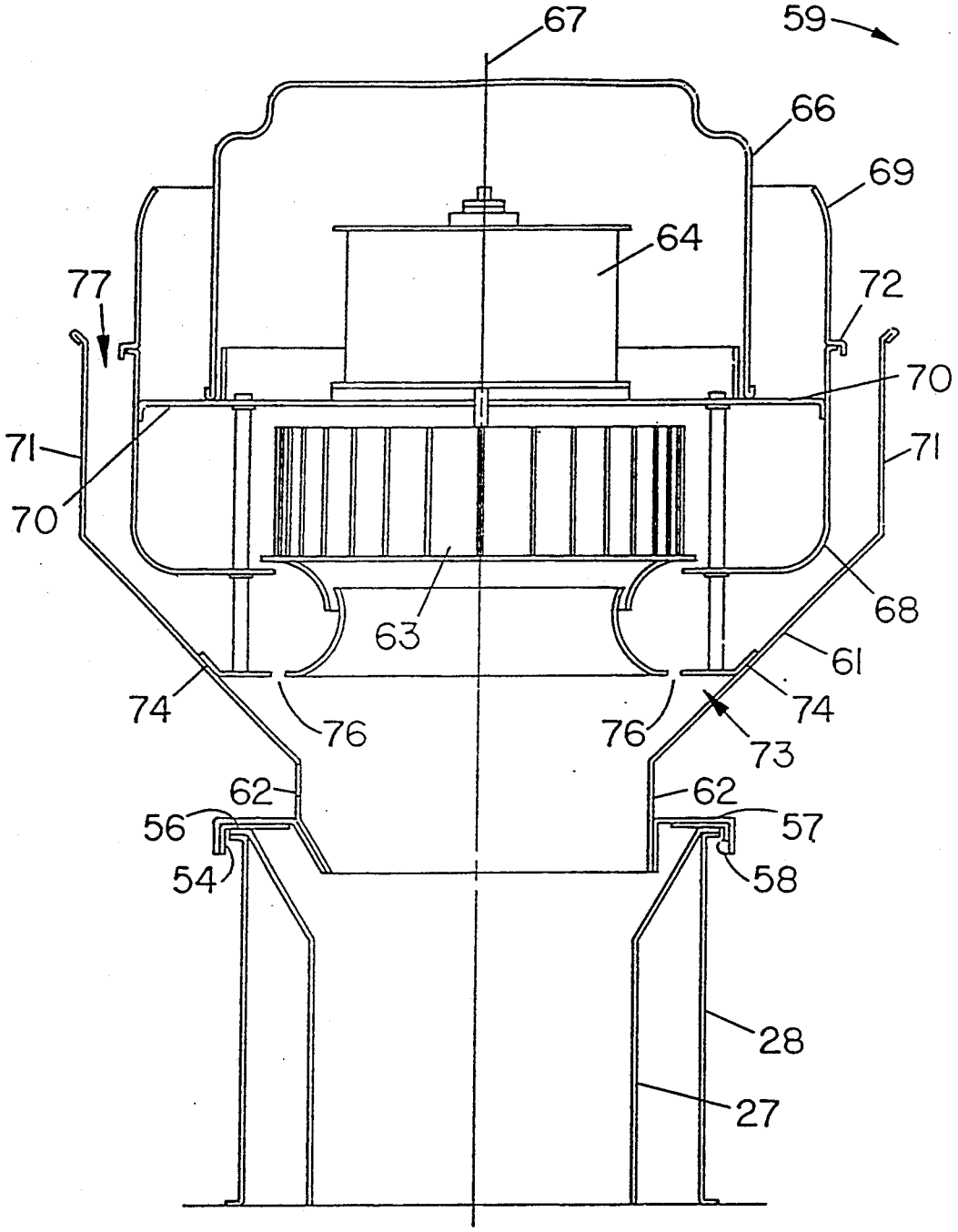
FIG. 7 is an enlarged vertical section through the exhaust fan installation.

Another feature of the invention is the power ventilator grease drain structure which actually becomes a fabricated portion of the exhaust fan assembly. The fan construction is modified to provide for free flow of water, snow and collected grease from inside the ventilator into the connecting exhaust duct. Referring particularly to FIGS. 1 and 7, the upper end of the duct 27 flares outward slightly and has an outwardly turned flange resting on top of the roof curb top flange. An exhaust fan assembly mounting frame 54 has an inwardly turned perimetrical flange 56 resting on the top flange of the duct and supported on it. This frame has a drain funnel frame 57 resting on top of it and connected to it by a hinge assembly 58 whereby the whole fan assembly can be swung outward in the direction of the arrow 59. A drain funnel has four sloping side walls 61 converging toward a rectangular tube 62 welded to the downwardly extending flanges of the funnel frame 57.

The blower assembly includes a blower wheel 63 driven by motor 64 in housing 66 about the vertical axis 67. The lower and upper windbands 68 and 69, respectively, are circular about axis 67, and are supported laterally below the upper margin of the lower windband by braces 70 extending laterally from support posts. The blower and windband assembly is supported on the funnel by a baseplate 73 which has a rectangular outer configuration, with slightly upturned marginal flanges 74 on all four sides and which rest on and are welded to the sloping sides 61 of the funnel. The upper edges of the funnel walls 71 are slightly outwardly flared, and double thick for rigidity. There is at least three inches clearance between the outer surfaces of the windbands and the inner surface of the vertical walls 71 of the funnel at the nearest points. Also, the walls 71 extend above the upper/lower windband joint 72. Thus the funnel captures any leakage from the fan windband and funnels the leakage to the square base of the device. The fan base 73 is provided with drain holes 76 sized to produce a static pressure drop greater than that created by the connecting duct and ventilator in the kitchen wall and are spaced equally and approximately 6 inches apart around the flat base of the fan. The greater pressure drop through the drain holes prevents the fan from drawing air from the atmosphere through the space 77 between the funnel and windbands and through the drain holes 76 and back into the fan. It thereby prevents short-circuiting exhausted air into the fan inlet.

OPERATION

Cleaning the Lineal Slot Ventilator: As the lineal slot ventilator is installed inside the wall behind the cooking appliances there are virtually no exposed surfaces requiring regular cleaning. The filters are installed inside the ventilator behind the filter access door. The access door is conveniently located at a height the operator can reach without climbing up on the appliances, and can be swung down fully 90 degrees as shown in dotted lines in FIG. 4, for removal of filters, if desired. But the doors can be swung down only 20 degrees from vertical and locked there for cleaning without removal of filters. The bottom trough of the ventilator is pitched from one end to the opposite end to provide for drainage directly into the building floor drain.

To clean the ventilator, a water spray nozzle is manually injected into the ventilation slot 34. From the slot the spray nozzle cleans the front inside of the chamber and the front surface of the baffle 44. Then, the filter access doors can be locked open at a 20° angle and the spray nozzle inserted to clean the top side of the grease filters. The access door is then opened fully, the grease filters turned upside down, the access door closed to 20° open position and the second side of the filters cleaned. Water evenly dispersed through the filters will clean the back side of the back of the chamber, and the back of the baffle is cleaned. The baffle 44 can be lowered and moved forward to the position shown in FIG. 6 so that the lower back wall 21 and the rear of baffle 44 can be cleaned by inserting the spray nozzle through the ventilation slot 34. To this point the operator has spent less time than would be required to clean the filters and the grease collection cups in a conventional system, and has actually done everything, except the duct and fan, that would be done in a one, two, four times per year complete system cleaning and without the cost of an outside professional service.

The cleaning of the duct and the fan can also be done by the restaurant employees because the duct is connected inside the wall to the plenum above the filters. All water sprayed into the duct for cleaning drains through the filters down the back of the air chamber and into the drain. No cooking appliance covers and no drain tubes are required. This has also been accomplished at one-half the equipment cost and 75% of the installation cost of a fixed pipe water wash ventilator. The filter access door and the ventilation slot provide access to the entire confines of the ventilator interior. All surfaces can be inspected and are accessible for service.

Cleaning the Power Ventilator Grease Drain and Fan:

When connected to the lineal slot ventilator, the same cleaning tools are used. A water supply line is installed to the roof at the side of the roof curb. A freeze proof nozzle is installed outside the curb, and the supply pipe inside the curb is heat taped to prevent freezing. The spray nozzle used to clean the ventilator is inserted first between the wind band 69 and fan motor housing 66 to clean the fan wheel and the inside of the wind band. Water spray traveling through the fan wheel drops into the exhaust duct. Secondly the nozzle is inserted between the wind band and the top 71 of the drain funnel to clean the area outside the fan windband and the inside surfaces of the drain. All water sprayed between the drain and the fan drain into the exhaust duct through the holes 76 in the base of the fan. Lastly, the funnel and fan assembly are lifted and swung open in the direction of the arrow 59 about the hinge 58. This allows access to the connecting duct. The duct can be washed with spray nozzle. All water and grease drain into the lineal slot ventilator down and out the connecting drain 52 to the sewer 53.

CONCLUSION

It should be understood that a ventilator is normally built to match the dimensions and requirements of the cooking appliances with which it is to be used. In the illustrated example, there would be cooking units located all the way across the front of the ventilator unit, although only two are shown in the drawings herein. If, for some reason, fewer than four cooking units such as 13 or 14, for example would be used, that portion of the intake slot 34 which would be away from any cooking units, could be plugged. The illustration in FIG. 3 shows dotted vertical outlines at each side of the ventilator to indicate that the ventilator could be any desired length within the scope of this invention to accommodate the number and width of cooking units that would be employed in the kitchen.

The vertical height of the slot 34 is 3 inches. The bottom of the slot is 2 to 3 inches above appliance cooking surface or hot oil or vent, as the case may be. Therefore the ventilator exhausting 36 inch high appliances uses the vertical dimensions available behind the cooking appliances themselves to provide a 36 inch plus downward flow and 39 inch plus upward flow of the induced air and fumes. This places the filter a minimum of 75 flow path inches away from the cooking surface but maintains the ventilation slot close to the source of fume emissions, thus providing improved performance without sacrificing safety. As is evident from the illustration in FIG. 2, since the horizontal distance from the front to the rear wall is 8 inches, the design of the ventilator allows it to be placed within a wall cavity as shown. In this installation no floor space and a very minimum amount of wall space is required by the ventilator. The lineal ventilator conserves valuable floor space by fitting within the wall cavity. To my knowledge, conventional hoods or ventilators as well as water wash ventilators are not available in the slim profile offered by my lineal slot ventilator, and the profile of the lineal slot ventilator, so slim as to make installation within a wall cavity, is unique to any ventilator with concealed removable internal grease extraction filters or baffles.

To summarize, therefore, the lineal slot ventilator of the present invention provides the separation between the grease filter and the cooking surface needed for fire safety, at a reasonable equipment and installation cost. The intake slot is provided the length of the cooking appliance. Air is exhausted into this slot horizontally and then turned vertically towards the bottom of the ventilator by an interior baffle. The length of this baffle is determined by the type of appliances being ventilated. Higher temperature appliances require a longer (top to bottom) baffle. At the bottom of the baffle the exhaust air is turned 180 degrees and is drawn up the back of the baffle to the grease filters. When ventilating a 36 inch high cooking appliance, the total length of air travel from its entrance at the intake slot and its arrival at the grease filter can be 48 inches. This 48 inch dimension provides adequate distance for the air exhausted from the cooking appliance to be mixed with air from the room and cooled to a safe temperature.

In a conventional ventilator, 48 inch separation could only be achieved with an overhead canopy hood. With a standard canopy hood being 24 inches high, a 36 inch appliance height plus 48 inch air space plus 24 inch canopy height requires 108 inches or a 9 foot ceiling height and wall space. Also, in an overhead canopy, lights are required to displace the shadow created by the canopy.

Maintenance is greatly reduced using the lineal slot ventilator of the present invention. Exhausted grease and smoke is drawn immediately into the intake slot of the lineal ventilator. No regular cleaning of the wall above, or the interior of the ventilator, is required. The ventilator filters and bottom chamber drain to one collection point, or directly to floor drain outside the ventilator. As the interior is not exposed, it need only be cleaned on the same schedule as the connecting duct and fan.

The lineal ventilator of the present invention, whether of the top-exhaust type shown herein, or a backshelf type, is contained within the wall cavity and not directly above the appliances, and can be cleaned by flushing just as the duct and fan above are cleaned. No one has to get on top of the appliances to get into the ventilator as they do where the appliances are under a canopy. The ventilator grease drain can be connected by hose directly to a floor drain, and all water and detergents used to flush the fan, duct and ventilator can travel into the bottom of the ventilator and out to the floor drain. Not only does this provide a more thorough cleaning of the ventilator, but also it is much easier than cleaning a conventional canopy.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. In a building having a roof and a kitchen with a floor and a wall and a cooking unit in front of the wall and having a cooking surface in a horizontal plane above the floor, a ventilating system including an intake unit the cooking unit comprising:

a housing including front, rear, top, bottom, left and right end walls for receiving and directing cooking fumes and located behind a vertical plane extending behind the cooking unit;

a horizontally extending slot at the front wall and located immediately above the level of the back of the cooking unit and communicating with the kitchen to receive cooking fumes from the cooking unit;

means for extending the travel distance of cooking fumes from the cooking unit to a grease separator means and including a first baffle having an upper end portion inside the housing behind the front wall at the level of the top of the slot and extending downward below the level of the horizontal plane of the cooking surface to a line near the bottom wall of the housing spaced in front of the rear wall of the housing; and said grease separator means extending between the front and rear walls above the baffle.

2. The intake unit of claim 1 and wherein:

the baffle upper end portion is hooked onto the hook portion of the housing whereby the baffle is hung in the housing, the baffle being capable of being unhooked and removed from said housing thereby facilitating complete cleaning of both the housing and the baffle.

3. The intake unit of claim 1 wherein the housing includes means for hanging the baffle in the housing; and the intake unit further comprising:

a baffle lower end guide in said housing to receive and locate the lower end of the baffle when hanging in the housing.

4. The intake unit of claim 3 and wherein:

the baffle lower end guide is a horizontally extending, upwardly opening channel pivotally mounted in the housing; and the baffle upper end is capable of being pivoted with the baffle lower end guide to a position in which the baffle upper end is resting against the rear wall of the housing to better facilitate complete cleaning of both the housing and the baffle.

5. The intake unit of claim 1 and further comprising:

clean out door means in the front wall of the housing above the slot, said door means being large enough to enable removal of the grease separator means through the door means.

6. The intake unit of claim 5 and wherein:

the housing is behind the kitchen facing surface of the kitchen wall;

the clean out door means include a clean out door that is hinged to the front wall of the housing above the slot and swings down in a direction outward from the housing into the kitchen for access to the separator means; and the unit further comprises:

means for locking the door partially open at an angle of about 20 degrees with respect to the front wall of the housing.

7. The intake unit of claim 1 and wherein:

the bottom of the housing is about 36 inches below the lower edge of the slot; and the separator means are about 44 inches above the bottom of the housing.

8. The intake unit of claim 7 and wherein:

the space between the front wall means and the rear wall means is about 8 inches.

9. The system of claim 1 and further comprising:

a roof mounted blower coupled to the top of the housing an moving kitchen air from immediately over the top of the cooking unit and into and through the slot and around the baffle and through the separator means and out above the roof of the building.

10. The system of claim 9 and further comprising:

building interior wall sheet material flush with the upper portion of the front wall means of the intake unit and providing a portion of the kitchen wall; and building interior wall sheet material flush with the lower portion of the front wall means of the intake unit below the slot and providing a portion of the kitchen wall behind the cooking units whereby the housing is located in a wall cavity behind the kitchen wall portions.

11. The ventilating system of claim 1 and wherein:

the intake unit is mounted in the building behind the wall of the kitchen.

12. A method of ventilating a kitchen comprising the steps of:

inducing room air of a kitchen to travel immediately over the top of the cooking unit and into a horizontally extending slot in an intake unit;

establishing a path of fumes form the slot to grease separator means;

causing the fumes to travel the path at least 48 inches from the slot to the separator means, with all of the path being below the level of the separator means and the fumes being caused to travel the majority of the path below the level of the top of the cooking unit.

13. In a kitchen ventilating system having an intake unit for fumes from a cooking appliance, a rooftop fan unit, and a connecting duct communicating between the intake unit and the fan unit, the improvement comprising:

a drain passage within the fan unit through the connecting duct to the intake unit, and wherein the drain passage is sized and arranged to prevent the rooftop fan unit from drawing ambient air into the connecting duct through the drain passage.

14. The improvement of claim 13 and further comprising:

a sewage drain inlet; and a drain line from the intake unit to the sewage drain inlet.

15. The improvement of claim 13 and wherein:

the fan unit includes a motor and a fan blower wheel and a windband assembly encircling the blower wheel and extending outwardly and upwardly around the perimeter of the blower wheel for directing upwardly the air discharged by the blower wheel, and the fan unit further comprises a funnel under the windband assembly and discharging into the duct.

16. In a kitchen ventilating system having an intake unit for fumes from a cooking appliance, a rooftop fan unit, and a connecting duct communicating between the intake unit and the fan unit, the improvement comprising:

a drain passage from the fan unit through the connecting duct to the intake unit;

the fan unit including a motor and a fan blower wheel and a windband assembly encircling the blower wheel and extending outwardly and upwardly around the perimeter of the blower wheel for directing upwardly the air discharged by the blower wheel, the fan unit further comprising a funnel under the windband assembly and discharging into the duct;

a rooftop curb around a portion of the duct;

the funnel being mounted to the curb; and the motor and blower wheel being mounted to the funnel.

17. The improvement of claim 16 and further comprising:

a blower wheel inlet duct and fan base between the connecting duct and the blower wheel and sealed to the funnel; and at least one drain hole in the fan base to take water collected in the windband and funnel and drain the water into the connecting duct.

18. The improvement of claim 17 and wherein:

the drain hole is small enough that the static pressure drop across it when the blower is running is greater than the static pressure drop from the intake unit to the blower wheel, to inhibit by-passing of air from the outlet of the blower wheel to the inlet of the blower wheel.

19. A method of funneling all rain precipitation entering a rooftop fan unit of a ventilating system and comprising the steps of:

providing a fan unit that includes a motor and a fan blower wheel and a wind band assembly encircling the blower wheel and extending outwardly and upwardly around the perimeter of the blower wheel for directing upwardly the air discharged by the blower wheel, and providing a funnel around the wind band assembly discharging into a duct which communicates between an intake unit and the fan unit;

collecting the rain in the fan unit; and discharging the precipitation down through the connecting duct and intake unit to a collection point in the ventilating system.

20. The method of claim 19 and further comprising: the step of draining the precipitation form the intake unit into a floor drain.

* * * * *

UNITED STATES PATENT AND TRADEMARK OFFICE

CERTIFICATE OF CORRECTION

PATENT NO. : 5,205,279

DATED : April 27, 1993

INVENTOR(S) : Stephen L. Brown

It is certified that error appears in the above-identified patent and that said Letters Patent is hereby corrected as shown below:

Claim 1, column 10, line 52, delete the words "the cooking unit".

Claim 1, column 11, line 1, after the word "housing" add --and--.

Claim 2, column 11, line 6, delete the second occurrence of "the" after "onto" and amend to --a--.

Claim 9, column 11, line 53, amend "an" to read --and--.

Claim 12, column 12, line 9, amend "form" to read --from--.

Signed and Sealed this

Fourth Day of January, 1994

Bruce Lehman

*Attest:*

BRUCE LEHMAN

*Attesting Officer*

*Commissioner of Patents and Trademarks*